US005125421A

United States Patent [19]

Mitchell

[11] Patent Number: 5,125,421

[45] Date of Patent: Jun. 30, 1992

[54] CALENDERED ULTRAPOROUS CIGARETTE PLUG WRAP, METHOD OF PRODUCING SAME AND CIGARETTES MADE FROM THE WRAP

[75] Inventor: Melvin G. Mitchell, Kingsport, Tenn.

[73] Assignee: P. H. Glatfelter Company, Spring Grove, Pa.

[21] Appl. No.: 643,346

[22] Filed: Jan. 22, 1991

[51] Int. Cl.[5] ..... A24D 1/02; A24D 1/04

[52] U.S. Cl. ..... 131/365; 131/361; 131/362; 131/336; 162/139

[58] Field of Search ..... 131/336, 365, 361, 362; 162/139

*Primary Examiner*—V. Millin

*Attorney, Agent, or Firm*—Kerkam, Stowell, Kondracki & Clarke

[57] ABSTRACT

An improved tobacco filter or plug wrap is made by calendering ultraporous paper. The calendering process reduces surface irregularities, reduces the thickness of the paper, and reduces the porosity. In general, during the calendering step, the ultraporous paper should be reduced in thickness from about 0.1 mils. to about 2.5 mils.

4 Claims, 1 Drawing Sheet

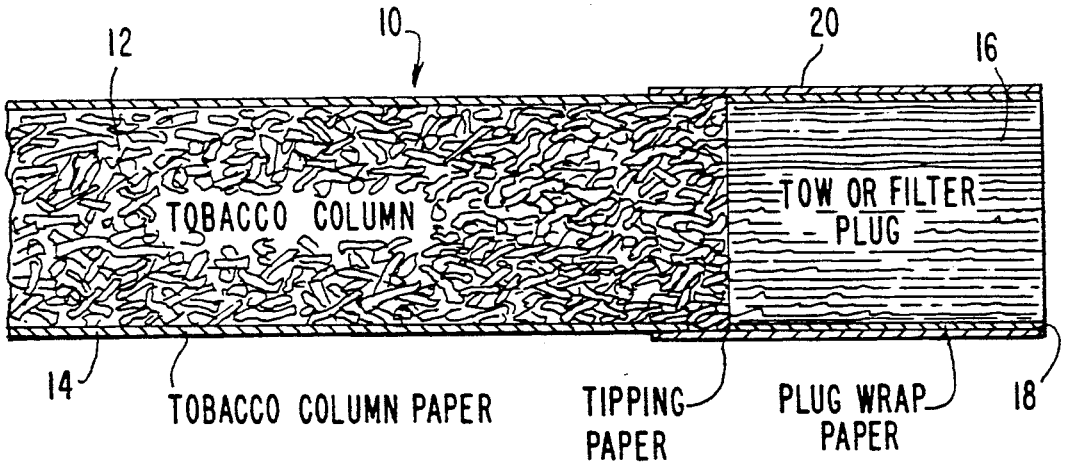
10
12
20
16
TOBACCO COLUMN
TOW OR FILTER PLUG
14
TOBACCO COLUMN PAPER
TIPPING PAPER
PLUG WRAP PAPER
18

CALENDERED ULTRAPOROUS CIGARETTE PLUG WRAP, METHOD OF PRODUCING SAME AND CIGARETTES MADE FROM THE WRAP

To practice the present invention, an ultraporous paper is formed on a fourdrinier machine from a furnish of a blend of softwood and hardwood pulps. The porosity of the formed sheet is from about 500 to about 26,000 coresta units and has a thickness of from about 1.5 to about 6.0 mils. The smoothness of the formed sheet is from about 250 to 420 Sheffield units. The sheet is then calendered to (a) reduce the porosity by about 500 to about 5,000 coresta units, (b) reduce the thickness by about 0.1 to about 2.5 mils. and (c) the smoothness by about 25 to about 300 Sheffield units.

BRIEF SUMMARY OF THE INVENTION

In cigarette assembly, the papers used are tipping paper, cigarette tobacco column paper, and filter plug wrap paper. In the past, generally the only tobacco paper that is occasionally calendered is the tipping paper. This is done to improve the surface for printing lines and logo designs on the tipping paper. Cigarette tobacco column papers and plug wraps were not calendered, because calendering causes paper to become less porous, less opaque and weaker. These changes are normally regarded as undesirable changes for cigarette paper and plug wraps and, further, calendering adds a process cost to the final product.

Applicant has discovered that calendering ultraporous plug wrap paper which would normally be regarded as an expensive disadvantage has the advantage that the hot-melt adhesives used to seal the seam of the filter plug wrap performs substantially better when the adhesive is applied to a smooth paper surface and to a sheet that more quickly allows heat transfer to a cooling bar. Calendered ultraporous plug wrap has a smoother surface than the comparable porosity normal ultraporous plug wrap. Thus, the applied hot-melt adhesive goes on smoother and has more contact area with both layers of the wrap. With uncalendered ultraporous paper, a portion of the hot-melt will not be applied to the valleys of the surface roughness and/or dive into the valleys and thus not be able to contact the other layer of the seam when the seam is formed. Further, it has been discovered that calendered ultraporous plug wrap is thinner than the comparable porosity normal ultraporous plug wrap. Thus, the heat transfer through the calendered ultraporous plug wrap would be increased, which would set up the adhesive bond faster. This reduces a problem known as rod long end break out.

BRIEF DESCRIPTION OF THE DRAWING

The drawing illustrates, in enlarged cross-section, a portion of a typical cigarette.

DETAILED DESCRIPTION OF THE INVENTION

Referring to the drawing, 10 generally designates a typical cigarette comprised of a column of tobacco 12 held in its desired configuration by a typical tobacco column paper 14.

At one end of the tobacco column is a filter plug typically cellulose acetate filter tow 16. The tow or filter plug 16 is wrapped with the novel calendered plug wrap paper 18 and, finally, the filter and tobacco column are joined by a tipping paper 20.

The plug wrap paper, like normal ultraporous plug wrap paper, is made on the same paper machine and uses substantially the same pulp furnish components. The paper machine is typically a fourdrinier set up for general production of light-weight porous plug wrap paper. There were no set-up changes made that are any different than any other common adjustments made for controlling the target paper base weight and porosity. The furnish components for the plug wrap are typical for plug wraps in general. The fiber furnish comprised a blend of commonly available pulps from vendors such as those listed in the Pulp & Paper directory. This is a common practice in making all papers in order to achieve equal final porosity for a customer; however, the base paper for the calendered ultraporous plug wrap is initially made more porous at the paper machine than the normal ultraporous plug wrap. This is done because the latter process of calendering compacts the paper and causes a reduction in porosity. The end result is a final porosity equal to what a customer desires.

Typical porosity, thickness, and smoothness data are shown in Table I.

TABLE I

| | Prior Art | Ultraporous Plug Wrap of the Invention | |
|---|---|---|---|
| | Ultraporous Plug Wrap | Before Calender | After Calender |
| Porosity, Coresta Units | 6900 | 7700 | 6800 |
| Thickness, Mils. | 2.48 | 2.52 | 1.72 |
| Smoothness, Sheffield | 350 | 340 | 265 |

A further comparison between a standard porous plug wrap and an ultraporous plug wrap is set forth in Table II.

TABLE II

| 7000 CORESTA ULTRAPOR DATA COMPARISON | | | |
|---|---|---|---|
| | | Density Trial | |
| | Standard Plug Wrap | Before Calender | After Calender |
| Porosity (Coresta) | 6827 | 8663 | 6923 |
| Basis Wght. (g/cm) | 22.3 | 22.0 | 22.1 |
| Thickness (Mil.) | 2.28 | 2.40 | 1.57 |
| Density (g/cm$^3$) | 0.38 | 0.36 | 0.55 |
| Smoothness (Sheffield) | 360 | 336 | 259 |

Calendering is an old and common process, as hereinbefore set forth, and in setting up the calendering press, it is basically a trial-and-error process, with the end result being controlled by the desired surface texture of the calendered paper and the desired porosity.

I claim:

1. A method of making a wrapper for cigarette filters comprising the steps of forming an ultraporous paper sheet and calendering the sheet to reduce the sheet's thickness from about 0.1 mils. to about 2.5 mils.

2. The method defined in claim 1 wherein the calendering step reduces the porosity of the formed sheet at least about 500 coresta units.

3. A method of making a wrap for a cigarette filter, the steps forming a sheet of paper having a porosity of about 500 to about 26,000 coresta units and calendering the sheet to reduce the porosity about 10–25%.

4. A cigarette comprising a tobacco column, a filter and an ultraporous calendered paper wrap for the filter.

* * * * *